US006748616B1

(12) United States Patent
Tseng

(10) Patent No.: US 6,748,616 B1
(45) Date of Patent: Jun. 15, 2004

(54) HAMMOCK WITH A SUPPORT ASSEMBLY

(75) Inventor: Chuen-Jong Tseng, Chiayi Hsien (TW)

(73) Assignee: Taiwan Shin Yeh Enterprise Co., Ltd., Chiayi Hsien (TW)

( * ) Notice: Subject to any disclaimer, the term of this patent is extended or adjusted under 35 U.S.C. 154(b) by 0 days.

(21) Appl. No.: 10/616,818

(22) Filed: Jul. 10, 2003

(51) Int. Cl.[7] ..... A45F 3/24
(52) U.S. Cl. ..... 5/710; 5/120; 5/127; 5/129
(58) Field of Search ..... 5/710, 120, 122, 5/126, 127, 129

(56) References Cited

U.S. PATENT DOCUMENTS 402,307 A * 4/1889 Collins ..... 5/128
679,963 A * 8/1901 Hayward ..... 5/129
6,360,383 B1 * 3/2002 Tseng ..... 5/129

* cited by examiner

*Primary Examiner*—Teri Pham Luu
*Assistant Examiner*—Fredrick Conley
(74) *Attorney, Agent, or Firm*—Ladas & Parry

(57) ABSTRACT

A support assembly for a hammock includes a base unit having a base body and a tubular member extending upwardly from the base body to define a shaft-receiving bore therein, and a canvas-mounting unit including a shaft that is mounted rotatably in the shaft-receiving bore, and that has an upper end protruding upwardly and outwardly from the shaft-receiving bore, and a holding seat fixed to the upper end of the shaft for co-rotation therewith.

6 Claims, 5 Drawing Sheets

HAMMOCK WITH A SUPPORT ASSEMBLY

BACKGROUND OF THE INVENTION

1. Field of the Invention

The invention relates to a hammock, more particularly to a hammock with a support assembly.

2. Description of the Related Art

Referring to FIG. 1, a conventional hammock 1 is shown to include two spaced apart transverse bases 11, a longitudinally extending generally U-shaped canvas-supporting frame 12 fixed on the transverse bases 11 to define a canvas-receiving space 13, and a canvas 10 that is disposed in the canvas-receiving space 13 above the canvas-supporting frame 12, and that has two opposing ends fastened respectively to top ends of the canvas-supporting frame 12 through fastening ropes.

One disadvantage of the conventional hammock resides in that the canvas-supporting frame 12 cannot rotate relative to the bases 11, thereby limiting the range of use of the conventional hammock.

SUMMARY OF THE INVENTION

Therefore, the object of this invention is to provide a hammock with a support assembly which can overcome the aforesaid disadvantage of the conventional hammock.

Accordingly, a hammock of the present invention includes: a base unit including a base body adapted to be seated on a supporting surface, and a tubular member extending upwardly from the base body and defining a shaft-receiving bore therein; a canvas-mounting unit including a shaft that is mounted rotatably in the shaft-receiving bore in the tubular member, and that has an upper end protruding upwardly and outwardly from the shaft-receiving bore, and a holding seat fixed to the upper end of the shaft for co-rotation therewith; a canvas support frame fixed securely on the holding seat, and having two opposite ends; and a canvas having two opposite ends respectively connected to the opposite ends of the canvas support frame.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENTS

Figure 1:
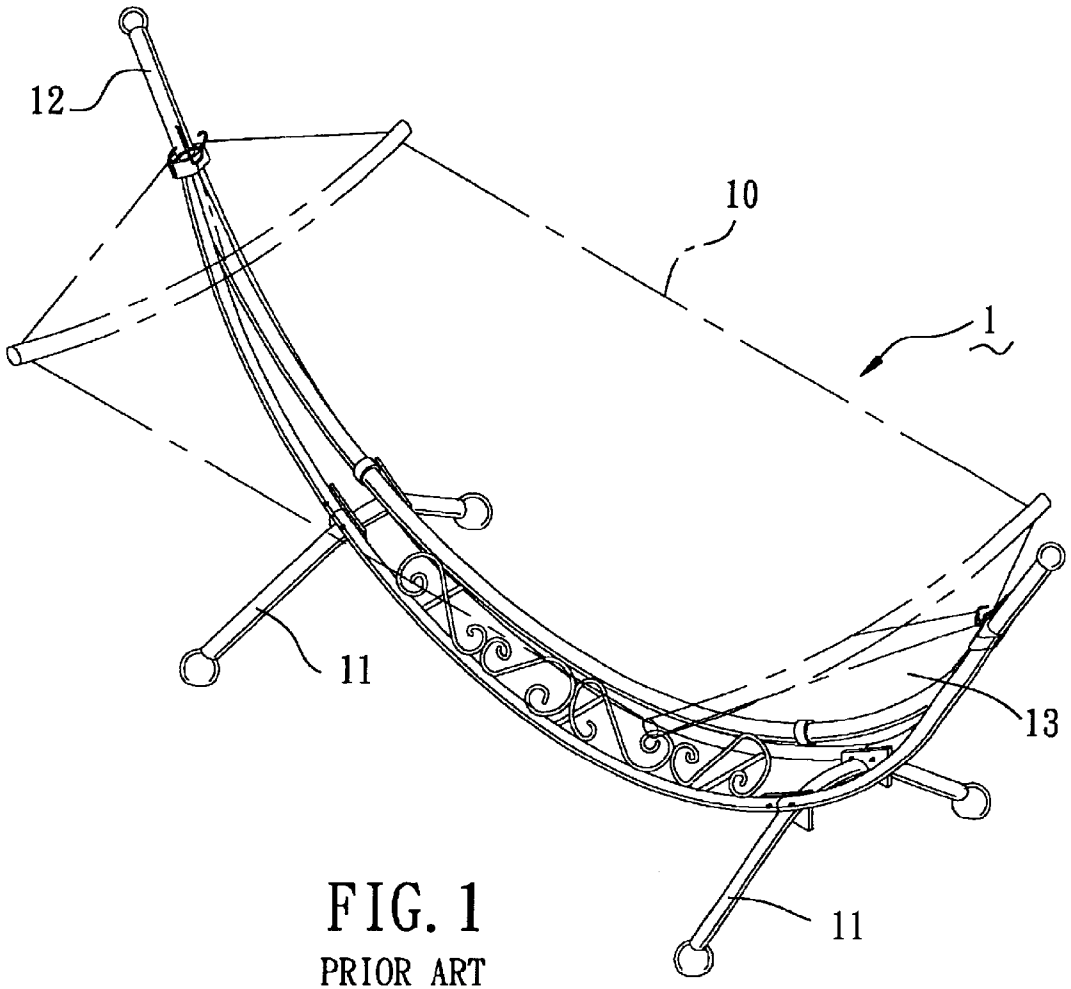
FIG. 1 PRIOR ART
FIG. 1 is a perspective view of a conventional hammock.
Figure 2:
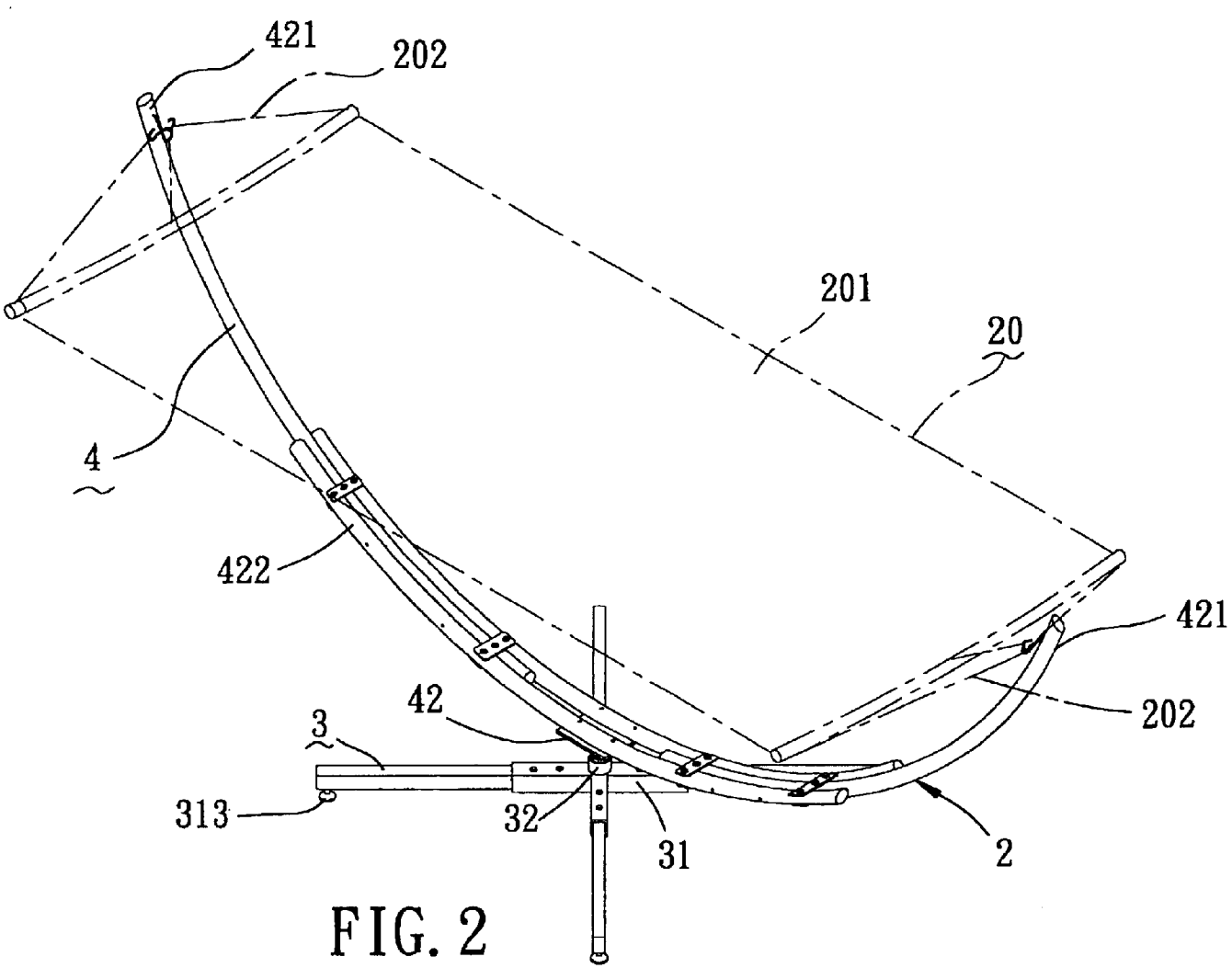
FIG. 2 is a perspective view of the preferred embodiment of a hammock with a support assembly according to the present invention.
Figure 3:
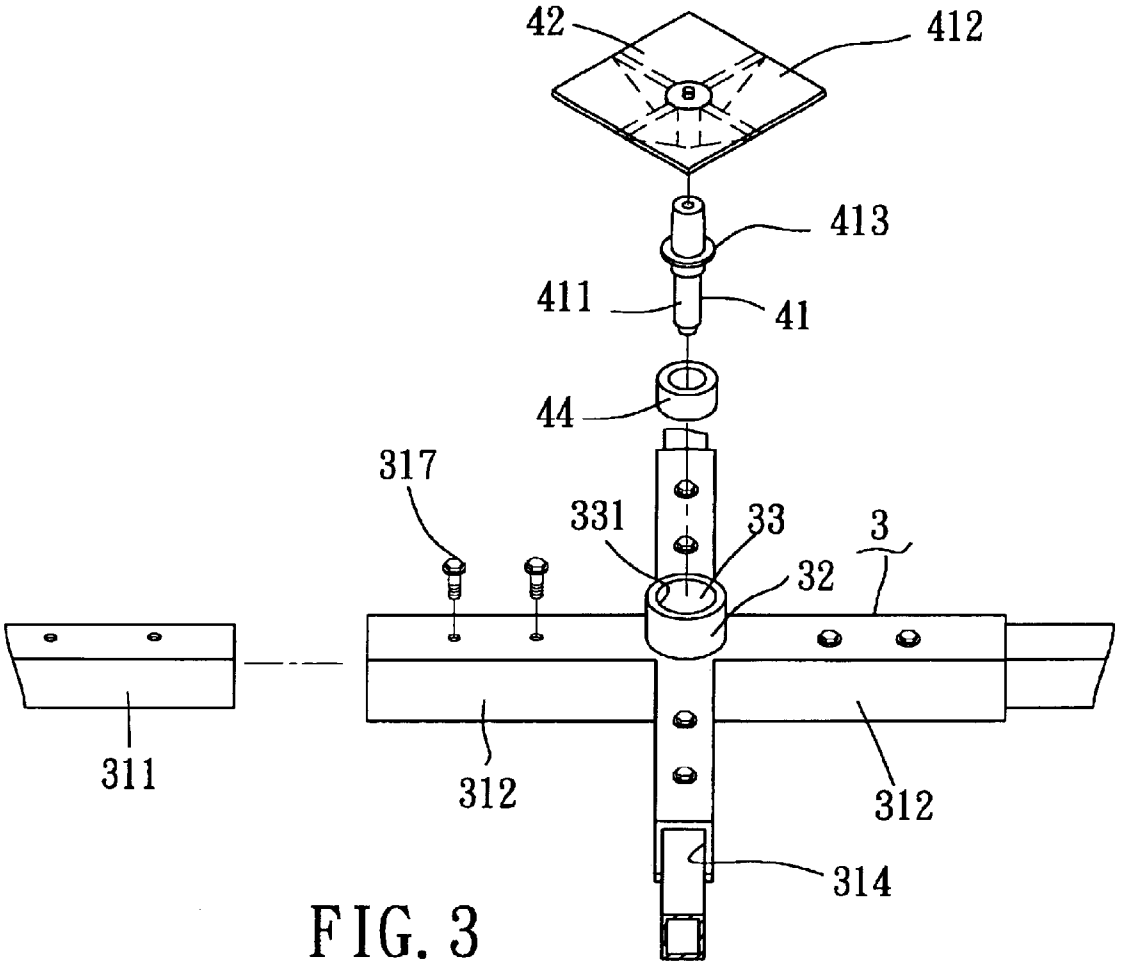
FIG. 3 is a fragmentary exploded perspective view of the preferred embodiment.
Figure 4:
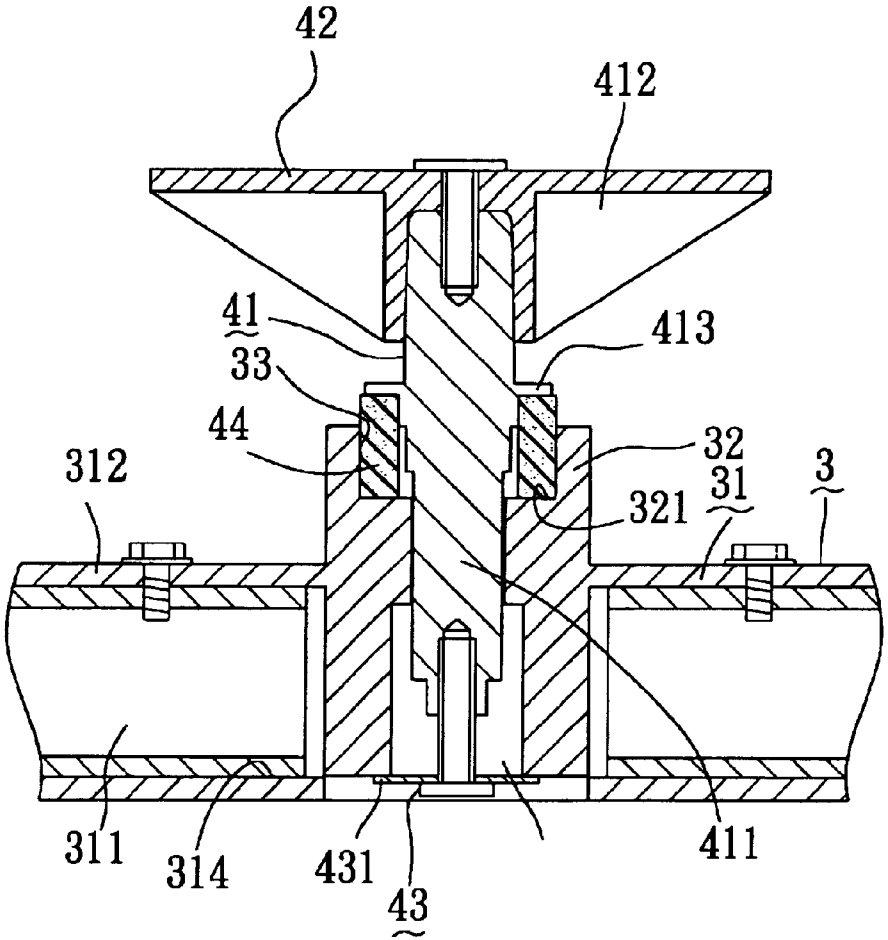
FIG. 4 is a fragmentary sectional view of the preferred embodiment.

Referring to FIGS. 2 to 4, the preferred embodiment of a hammock with a support assembly according to this invention is shown to include a base unit 3 and a canvas-mounting unit 4.

As illustrated, the base unit 3 includes a base body 31 adapted to be seated on a supporting surface, and a tubular member 32 that extends upwardly from the base body 31 and that defines a shaft-receiving bore 33 therein.

The canvas-mounting unit 4 includes a shaft 41 that is mounted rotatably in the shaft-receiving bore 33 in the tubular member 32, and that has a lower end 411 extending into the shaft-receiving bore 33, and an upper end protruding upwardly and outwardly from the shaft-receiving bore 33. The canvas-mounting unit 4 further includes a holding seat 42 fixed to the upper end of the shaft 41 for co-rotation therewith. A washer 431 is disposed below a bottom end of the base body 31. A coupling bolt 43 extends through the washer 431 and into the base body 31, and engages the lower end 411 of the shaft 41 so as to prevent untimely and undesired removal of the shaft 41 from the shaft-receiving bore 33. The canvas-mounting unit 4 further includes a canvas support frame having a generally U-shaped rod unit 422 that is fixed securely on an upper face 412 of the holding seat 42 and that has two opposite ends 421. A canvas 20 includes a canvas body 201 having two opposite ends connected respectively to the opposite ends 421 of the U-shaped rod unit 422 through fastening ropes 202. Under this condition, the canvas 20 can swing to and fro relative to the U-shaped rod unit 422 and can rotate simultaneously with the U-shaped rod unit 422 and the holding seat 42 upon rotation of the shaft 41 in the shaft-receiving bore 33.

In this preferred embodiment, the tubular member 32 of the base unit 3 has an inner wall surface 331 defining the shaft-receiving bore 33, and is formed with an annular inner flange 321 protruding inwardly and radially from the inner wall surface 331 into the shaft-receiving bore 33. The shaft 41 is preferably formed with an annular outer flange 413 that protrudes outwardly and radially therefrom, and that is disposed above the inner flange 321 of the tubular member 32. The support assembly 4 further includes a sleeve member 44 that is sleeved on the shaft 41, that is in sliding contact with the inner wall surface 331 of the tubular member 32 and the shaft 41, and that is sandwiched between the outer flange 413 of the shaft 41 and the inner flange 321 of the tubular member 32. The sleeve member 44 can be made from an elastomeric material or plastic material. Preferably, the base body 31 includes laterally extending first and second tubes 312 that intersect each other to define an intersection. The tubular member 32 projects upwardly from the intersection of the first and second tubes 312. Each of the first and second tubes 312 has two opposite ends, and defines a rod-receiving space 314 therein. The base body 31 further includes four extension rods 311 that are respectively inserted into the rod-receiving spaces 314 through the ends of the first and second tubes 312 and that are secured to the first and second tubes 312 through adjustable bolts 317. Preferably, each of the extension rods 311 has a bottom face provided with a footing 313.

Figure 5:
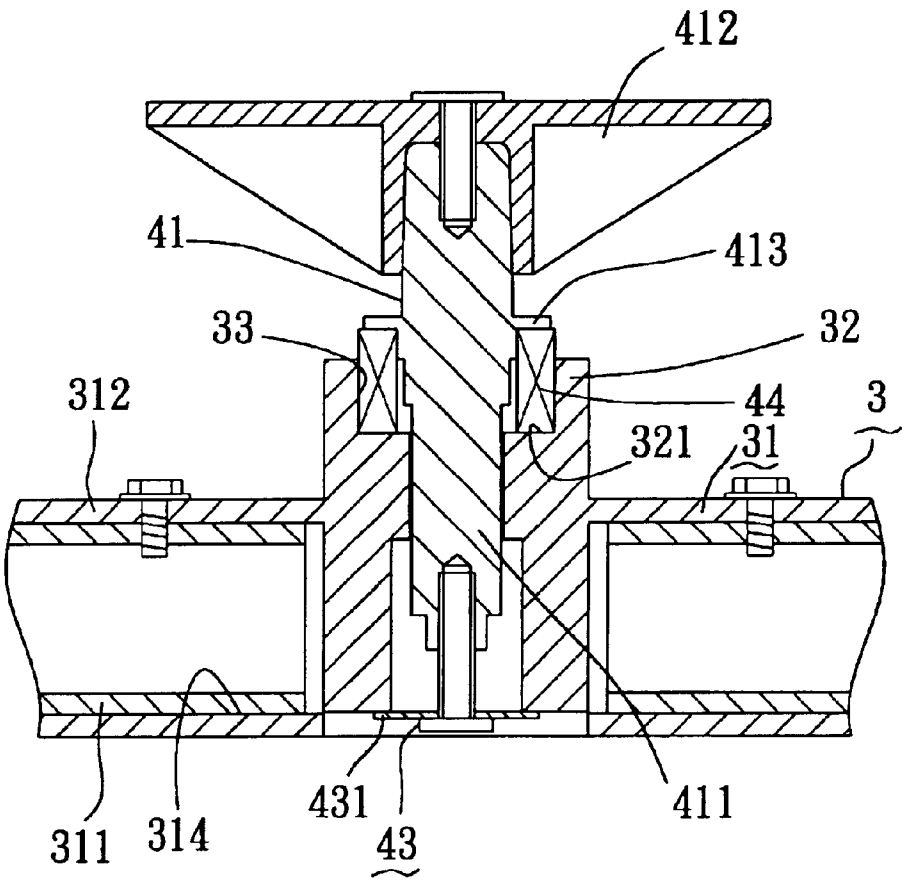
FIG. 5 is a fragmentary sectional view of a modified preferred embodiment of a hammock with a support assembly according to the present invention.

Referring to FIG. 5, a modified preferred embodiment of the present invention is shown to have a construction similar to that of the previous embodiment. The only difference resides in that a conventional bearing is used instead of the sleeve 44 to facilitate rotation of the shaft 41 relative to the tubular member 32.

With this invention thus explained, it is apparent that numerous modifications and variations can be made without departing from the scope and spirit of this invention. It is therefore intended that this invention be limited only as indicated in the appended claims.

What is claimed is:

1. A support assembly for a hammock having a canvas, comprising:

a base unit including a base body adapted to be seated on a supporting surface, and a tubular member extending upwardly from said base body and defining a shaft-receiving bore therein; and a canvas-mounting unit including a shaft that is mounted rotatably in said shaft-receiving bore in said tubular member, and that has an upper end protruding upwardly and outwardly from said shaft-receiving bore, and a holding seat fixed to said upper end of said shaft for co-rotation therewith and adapted for mounting of the canvas.

2. The support assembly as defined in claim 1, wherein said tubular member of said base unit has an inner wall surface defining said shaft-receiving bore, and is formed with an annular inner flange protruding inwardly and radially from said inner wall surface into said shaft-receiving bore, said shaft being formed with an annular outer flange protruding outwardly and radially therefrom and disposed above said inner flange, said support assembly further comprising a sleeve member that is sleeved on said shaft, that is in sliding contact with said inner wall surface of said tubular member and said shaft, and that is sandwiched between said outer flange of said shaft and said inner flange of said tubular member.

3. The support assembly as defined in claim 2, wherein said sleeve is a bearing.

4. The support assembly as defined in claim 2, wherein said sleeve is made from an elastomeric material.

5. The support assembly as defined in 2, wherein said base body includes laterally extending first and second tubes that intersect each other to define an intersection, said tubular member projecting upwardly from said intersection, each of said first and second tubes having two opposite ends, and defining a rod-receiving space between said two opposite ends, said base body further including four extension rods that are respectively inserted through said ends of said first and second tubes and into said rod-receiving spaces in said first and second tubes and that are secured to said first and second tubes.

6. A hammock comprising:

a base unit including a base body adapted to be seated on a supporting surface, and a tubular member extending upwardly from said base body and defining a shaft-receiving bore therein;

a canvas-mounting unit including a shaft that is mounted rotatably in said shaft-receiving bore in said tubular member, and that has an upper end protruding upwardly and outwardly from said shaft-receiving bore, and a holding seat fixed to said upper end of said shaft for co-rotation therewith;

a canvas support frame fixed securely on said holding seat, and having two opposite ends; and a canvas having two opposite ends respectively connected to said opposite ends of said canvas support frame.

* * * * *